US010165344B2

(12) United States Patent
Imai et al.

(10) Patent No.: US 10,165,344 B2
(45) **Date of Patent: *Dec. 25, 2018**

(54) HEADPHONE

(71) Applicants: SINTAI OPTICAL (SHENZHEN) CO., LTD., Shenzhen, Guangdong Province (CN); ASIA OPTICAL INTERNATIONAL LTD., Tortola (VG)

(72) Inventors: Naofumi Imai, Taichung (TW); Takayuki Karasawa, Taichung (TW); Tomoya Takahashi, Taichung (TW)

(73) Assignees: SINTAI OPTICAL (SHENZHEN) CO., LTD., Shenzhen, Guandong Province (CN); ASIA OPTICAL INTERNATIONAL LTD., Tortola (VG)

( * ) Notice: Subject to any disclaimer, the term of this patent is extended or adjusted under 35 U.S.C. 154(b) by 0 days.

This patent is subject to a terminal disclaimer.

(21) Appl. No.: 15/292,829

(22) Filed: Oct. 13, 2016

(65) Prior Publication Data

US 2017/0214993 A1 Jul. 27, 2017

(30) Foreign Application Priority Data

Jan. 27, 2016 (CN) ..... 2016 1 0054554

(51) Int. Cl.
*H04R 1/26* (2006.01)
*H04R 1/10* (2006.01)
(Continued)

(52) U.S. Cl.
CPC ..... *H04R 1/1008* (2013.01); *H04R 1/1075* (2013.01); *H04R 1/323* (2013.01);
(Continued)

(58) Field of Classification Search
CPC ..... H04R 1/1075
See application file for complete search history.

(56) References Cited

U.S. PATENT DOCUMENTS 4,005,278 A * 1/1977 Gorike ..... H04R 5/033 181/137
2001/0005422 A1* 6/2001 Nakamura ..... H04R 1/2819 381/349

(Continued)

FOREIGN PATENT DOCUMENTS

CN 1264381 C 7/2006
CN 204069266 U 12/2014
CN 103067827 B 5/2015

OTHER PUBLICATIONS

TW Office Action dated Feb. 9, 2017 in Taiwan application (No. 105102456).

*Primary Examiner* — Matthew Eason
*Assistant Examiner* — Phan Le
(74) *Attorney, Agent, or Firm* — McClure, Qualey & Rodack, LLP

(57) ABSTRACT

A headphone is provided. The headphone includes a housing and an speaker. The housing includes a first layer structure, a first receiving space, a first output path, a first trench and a sound output side. The speaker is located in the first receiving space, wherein the speaker includes a first speaker orientation, and the first speaker orientation corresponds to the first output path. The first output path includes the first trench, which is located at the first layer structure, extends around the speaker, and is connected to the sound output side.

15 Claims, 8 Drawing Sheets

(51) Int. Cl.
*H04R 1/32* (2006.01)
*H04R 1/28* (2006.01)
*H04R 5/033* (2006.01)

(52) U.S. Cl.
CPC ..... *H04R 1/26* (2013.01); *H04R 1/2811* (2013.01); *H04R 1/2857* (2013.01); *H04R 5/033* (2013.01); *H04R 2205/022* (2013.01); *H04R 2460/11* (2013.01)

(56) References Cited

U.S. PATENT DOCUMENTS

2004/0218775 A1* 11/2004 Huang ..... H04R 1/1075 381/371
2013/0336512 A1* 12/2013 Kim ..... H04R 1/1016 381/380

* cited by examiner

HEADPHONE

CROSS REFERENCE TO RELATED APPLICATIONS

This Application claims priority of China Patent Application No. 201610054554.9, filed on Jan. 27, 2016, the entirety of which is incorporated by reference herein.

BACKGROUND OF THE INVENTION

Field of the Invention

The present invention relates to a headphone, and in particular to a multi-channel headphone.

Description of the Related Art

Conventional multi-channel headphones have a cover, a subwoofer speaker, a plurality of single channel cases, and a plurality of single channel speakers. The single channel cases are disposed in the cover, and the subwoofer speaker is also disposed in the cover. The cover is utilized as a resonance case. The single channel speakers are respectively disposed on the single channel cases. The multi-channel headphone provides sound output from at least four channels and the two subwoofer channels.

However, a conventional multi-channel headphone simply provides monotonous sound output. Additionally, the speakers of the conventional multi-channel headphone are located on the same level, which cannot produce a diverse sound environment and a spatial sense of the sound field.

BRIEF SUMMARY OF THE INVENTION

In one embodiment, a headphone is provided. The headphone includes a housing and an speaker. The housing includes a first layer structure, a first receiving space, a first output path, a first trench, and a sound output side. The speaker is located in the first receiving space, wherein the speaker includes a first speaker orientation, and the first speaker orientation corresponds to the first output path. The first output path includes the first trench, which is located at the first layer structure, extends around the speaker, and is connected to the sound output side.

In one embodiment, the housing further comprises a second output path, the speaker further comprises a second speaker orientation, and the second speaker orientation corresponds to the second output path.

In one embodiment, the first speaker orientation is disposed next to the second speaker orientation, and the first speaker orientation and the second speaker orientation are arranged at inclined angles of about −10°~10°.

In one embodiment, the first speaker orientation and the second speaker orientation provide sounds with the same frequency or different frequencies.

In one embodiment, the length of the first output path is longer than the length of the second output path.

In one embodiment, a crossfeed output path, traveling between a second layer structure of the housing and a cover structure of the housing, passes through the second layer structure and the first layer structure to the sound output side.

In one embodiment, a second layer structure of the housing comprises an opening portion, a protrusion and a first through hole, and the opening portion corresponding to a crossfeed speaker, and a cover structure of the housing comprises a second trench, the second trench corresponding to the opening portion, the protrusion and the first through hole, and a crossfeed output path travels along the opening portion, the second trench and the first through hole to leave the second layer structure.

In one embodiment, the headphone further comprises a crossfeed speaker, wherein the crossfeed speaker comprises a crossfeed speaker orientation, the crossfeed speaker orientation corresponds to a crossfeed output path, wherein the housing further comprises a second receiving space, and the crossfeed speaker is located in the second receiving space.

In one embodiment, the housing further comprises a cover structure and a second layer structure, wherein the second layer structure is disposed between the first layer structure and the cover structure, and the first layer structure is disposed between the second layer structure and the sound output side. The first receiving space and the second receiving space are disposed in the second layer structure, and the speaker and the crossfeed speaker are disposed in the first layer structure.

In one embodiment, the second layer structure comprises an opening portion, a protrusion and a first through hole. The crossfeed output path travels between the second layer structure and the cover structure, passing through the second layer structure and the first layer structure to the sound output side. The opening portion corresponds to the crossfeed speaker. The cover structure comprises a second trench, wherein the second trench corresponds to the opening portion, the protrusion, and the first through hole. The crossfeed output path travels along the opening portion, the second trench, and the first through hole to leave the second layer structure. The first layer structure comprises a second through hole. The second through hole corresponds to the first through hole. The crossfeed output path travels from the second layer structure along the first through hole and the second through hole, passing through the first layer structure to the sound output side.

In one embodiment, the crossfeed output path travels between the second layer structure and the cover structure, passing through the second layer structure and the first layer structure to the sound output side.

In one embodiment, the second layer structure comprises an opening portion, a protrusion and a first through hole. The opening portion corresponds to the crossfeed speaker. The cover structure comprises a second trench, the second trench corresponds to the opening portion, the protrusion and the first through hole. The crossfeed output path travels along the opening portion, the second trench and the first through hole to leave the second layer structure.

In one embodiment, the first layer structure comprises a second through hole. The second through hole corresponds to the first through hole. The crossfeed output path travels from the second layer structure along the first through hole and the second through hole, passing through the first layer structure to the sound output side.

In one embodiment, the second output path extends into the first layer structure and passes through the first layer structure to the sound output side.

In one embodiment, the first layer structure comprises a third through hole. The third through hole is connected to the first trench. The first output path travels along the first trench and the third through hole to leave the first layer structure.

In one embodiment, the first trench comprises a comb-shaped portion.

In one embodiment, the speaker is disposed between the second through hole and the third through hole.

In one embodiment, the second layer structure further comprises a plurality of vents. The vents correspond to the speaker.

Utilizing the headphone of the embodiment of the invention with the crossfeed speaker, both the left ear and the right ear of the user can hear the sound of the right sound channel and the left sound channel. The design of the protrusion and the design of the path length and the shapes of the second trench and the third trench modify the time difference of the sound therein. Additionally, the frequency can be modified by the design of breathable holes and the first trench.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
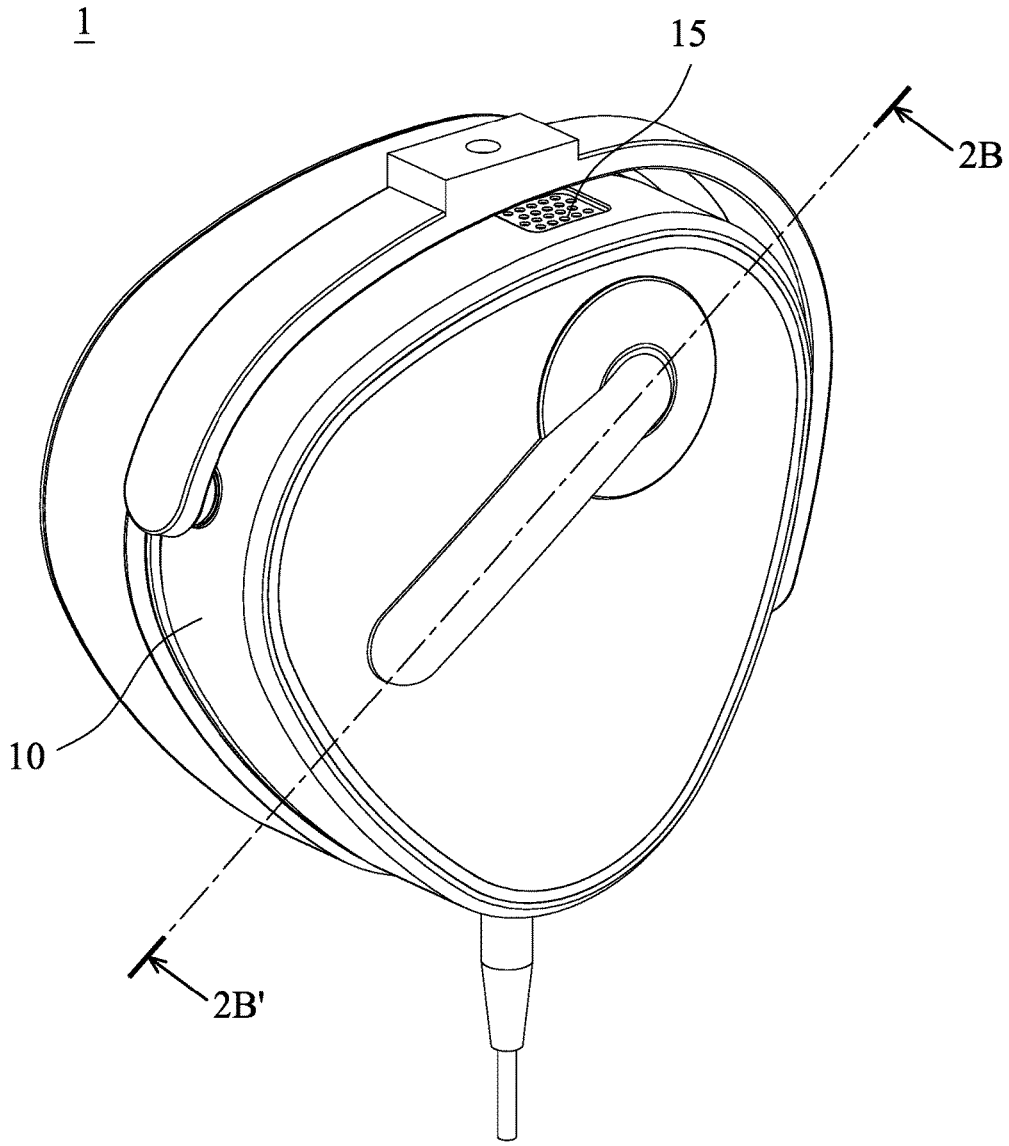
FIG. 1A is an assembled view of a headphone of an embodiment of the invention.
Figure 1B:
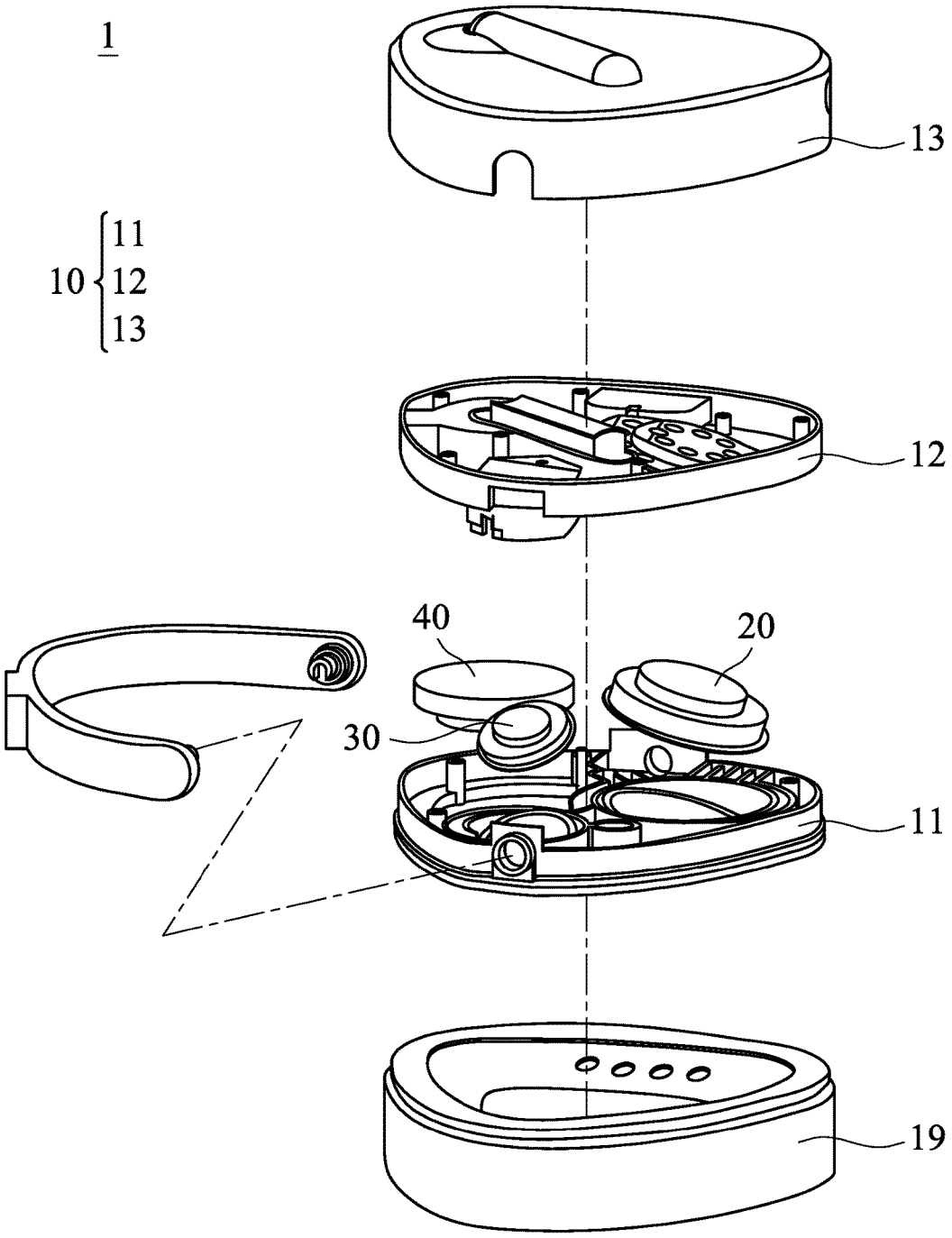
FIG. 1B is an exploded view of the headphone of the embodiment of the invention.

FIGS. 1A and 1B show a headphone 1 of an embodiment of the invention. The headphone 1 includes a housing 10, a low-pitch speaker (speaker) 20, a low-pitch auxiliary path (first output path), a high-pitch speaker 30, a high-pitch auxiliary path, a crossfeed speaker 40, and a crossfeed output path. The housing 10 comprises a sound output side 19. The low-pitch speaker 20 provides a low-pitch sound. At least a portion of the low-pitch sound travels from the low-pitch speaker 20, passing through the low-pitch auxiliary path, and is output through the sound output side 19. The high-pitch speaker 30 provides a high-pitch sound. At least a portion of the high-pitch sound travels from the high-pitch speaker 30, passing through the high-pitch auxiliary path 31, and is output through the sound output side 19. The crossfeed speaker 40 provides a crossfeed sound. The crossfeed sound travels from the crossfeed speaker 40, passing through the crossfeed output path, and is output through the sound output side 19.

In one embodiment, the housing 10 comprises a cover 13, a first layer structure 11 and a second layer structure 12. The second layer structure 12 is disposed between the first layer structure 11 and the cover structure 13. The first layer structure 11 is disposed between the second layer structure 12 and the sound output side 19. The low-pitch speaker 20, the high-pitch speaker 30 and the crossfeed speaker 40 are disposed on the first layer structure. The low-pitch speaker 20, the high-pitch speaker 30 and the crossfeed speaker 40 can be fixed by magnetic force or wedging.

Figure 2A:
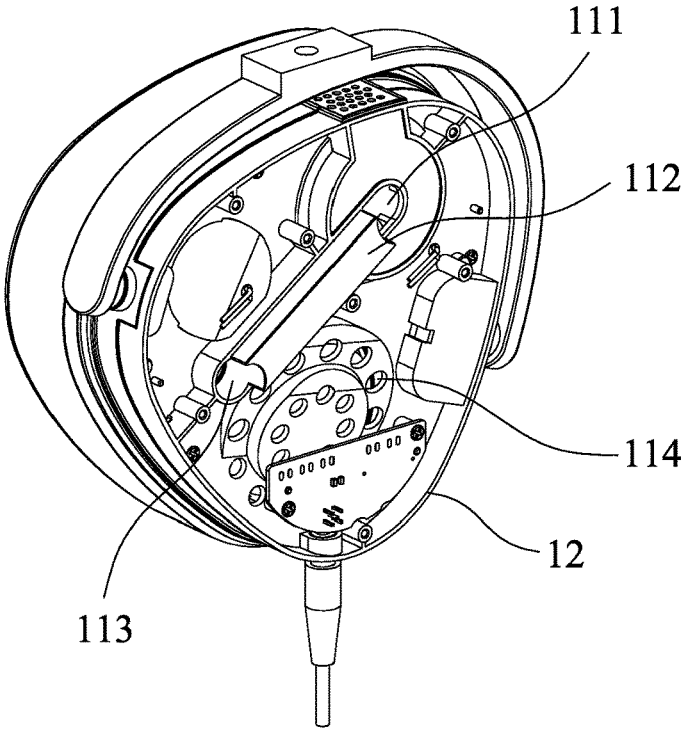
FIG. 2A shows a detailed structure of a second layer structure of the embodiment of the invention.
Figure 2B:
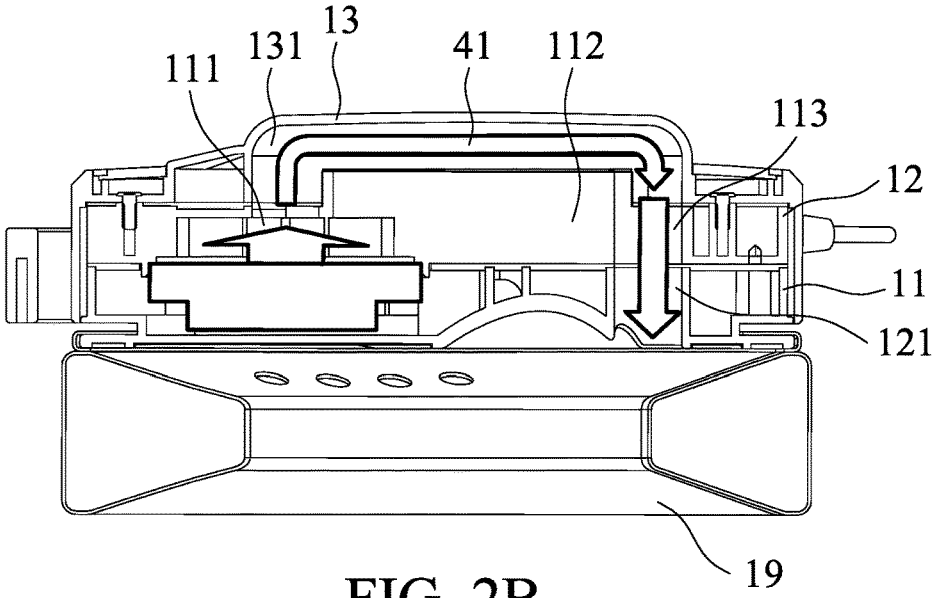
FIG. 2B is a cross sectional view along 2B-2B' direction of FIG. 1A.

FIG. 2A shows a detailed structure of the second layer structure 12, wherein the crossfeed output path 41 extends on the second layer structure 12, and passes through the second layer structure 12 and the first layer structure 11 to the sound output side 19. The second layer structure 12 includes an opening portion 111, a protrusion 112 and a first through hole 113. The opening portion 111 corresponds to the crossfeed speaker 40. With reference to FIG. 2B, which is a sectional view along 2B-2B' direction of FIG. 1A, the cover structure 13 comprises a second trench 131 corresponding to the opening portion 111, the protrusion 112, and the first through hole 113. The crossfeed output path 41 extends along the opening portion 111, the second trench 131 and the first through hole 113 to leave the second layer structure 12. The first layer structure 11 comprises a second through hole 121 corresponding to the first through hole 113. The crossfeed output path 41 travels from the second layer structure 12, passing through the first layer structure 11 to the sound output side 19 along the first through hole 113 and the second through hole 121.

In this embodiment, the second trench 131 is a straight-line shaped trench.

With reference to FIG. 2A, in one embodiment, the second layer structure 12 further comprises a plurality of vents 114, and the vents 114 correspond to the low-pitch speaker 20.

Figure 3A:
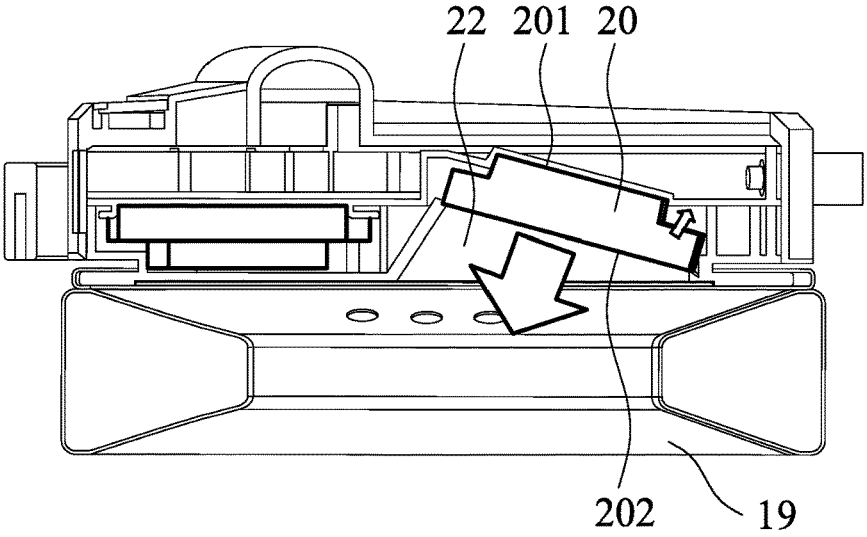
FIG. 3A shows a low-pitch speaker and a low-pitch major path of the embodiment of the invention.
Figure 3B:
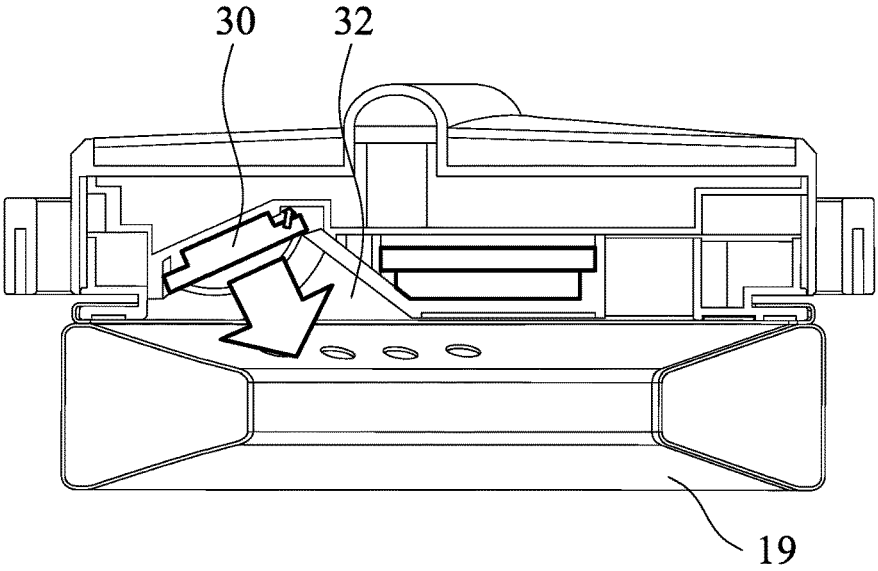
FIG. 3B shows a high-pitch speaker and a high-pitch major path of the embodiment of the invention.

With reference to FIGS. 3A and 3B, the inclined low-pitch speaker 20 has a first speaker surface 201 and a second speaker surface 202. The first speaker surface 201 corresponds to the low-pitch auxiliary path (first output path). The second speaker surface 202 outputs at least a portion of the low-pitch sound toward the sound output side 19 via a low-pitch major path (second output path) 22. In one embodiment, the first speaker surface 201 is disposed next to the second speaker surface 202, and the first speaker surface 201 and the second speaker surface 202 are arranged at inclined angles of about −10°~10°. The first speaker surface 201 and the second speaker surface 202 provide sounds with the same frequency or different frequencies. The inclined arranged high-pitch speaker 30 outputs at least a portion of the high-pitch sound toward the sound output side 19 via a high-pitch major path 32. A portion of the low-pitch sound of the low-pitch speaker 20, due to the inclined design of the low-pitch speaker 20, passes through the low-pitch auxiliary path 21 to the sound output side 19. A portion of the high-pitch sound of the high-pitch speaker 30, due to the inclined design of the high-pitch speaker 30, passes through the high-pitch auxiliary path 31 to the sound output side 19 to generate stereo sound. The length of the low-pitch auxiliary path 21 is much longer than that of the low-pitch major path 22. The length of the high-pitch auxiliary path 31 is much longer than that of the high-pitch major path 32. In particular, in one embodiment, the length of the low-pitch auxiliary path 21 is 2-15 times of the length of the low-pitch major path 22, and the length of the high-pitch auxiliary path 31 is 2-17 times of the length of the high-pitch major path 32.

Figure 3C:
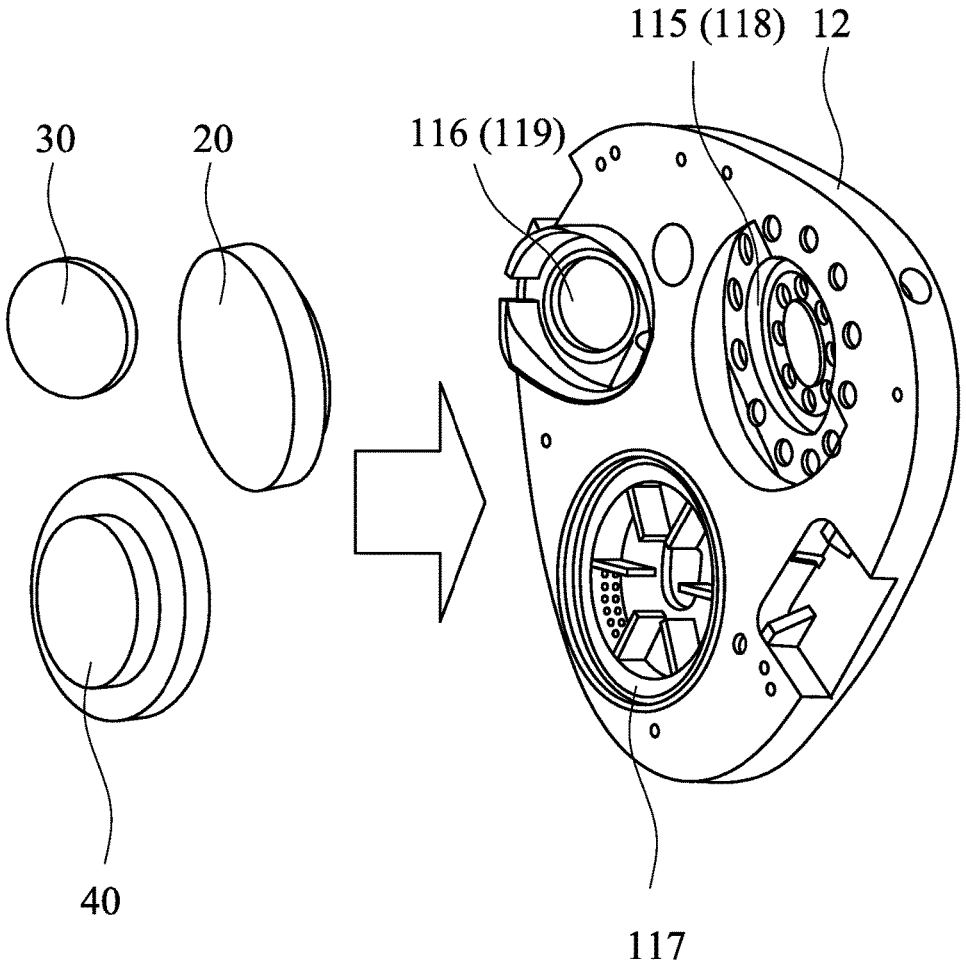
FIG. 3C shows the low-pitch speaker, the high-pitch speaker and a crossfeed speaker of the embodiment of the invention.

FIG. 3C shows the low-pitch speaker 20, the high-pitch speaker 30, and the crossfeed speaker 40. The second layer structure 12 comprises a first receiving space 115, a third receiving space 116 and a second receiving space 117. The first receiving space 115 includes a first inclined surface 118. The third receiving space 116 comprises a second inclined surface 119. The low-pitch speaker 20 is embedded into the first receiving space 115 and is in contact with the first inclined surface 118. The high-pitch speaker 30 is embedded into the third receiving space 116 and is in contact with the second inclined surface 119. The crossfeed speaker 40 is embedded into the second receiving space 117.

Figure 4A:
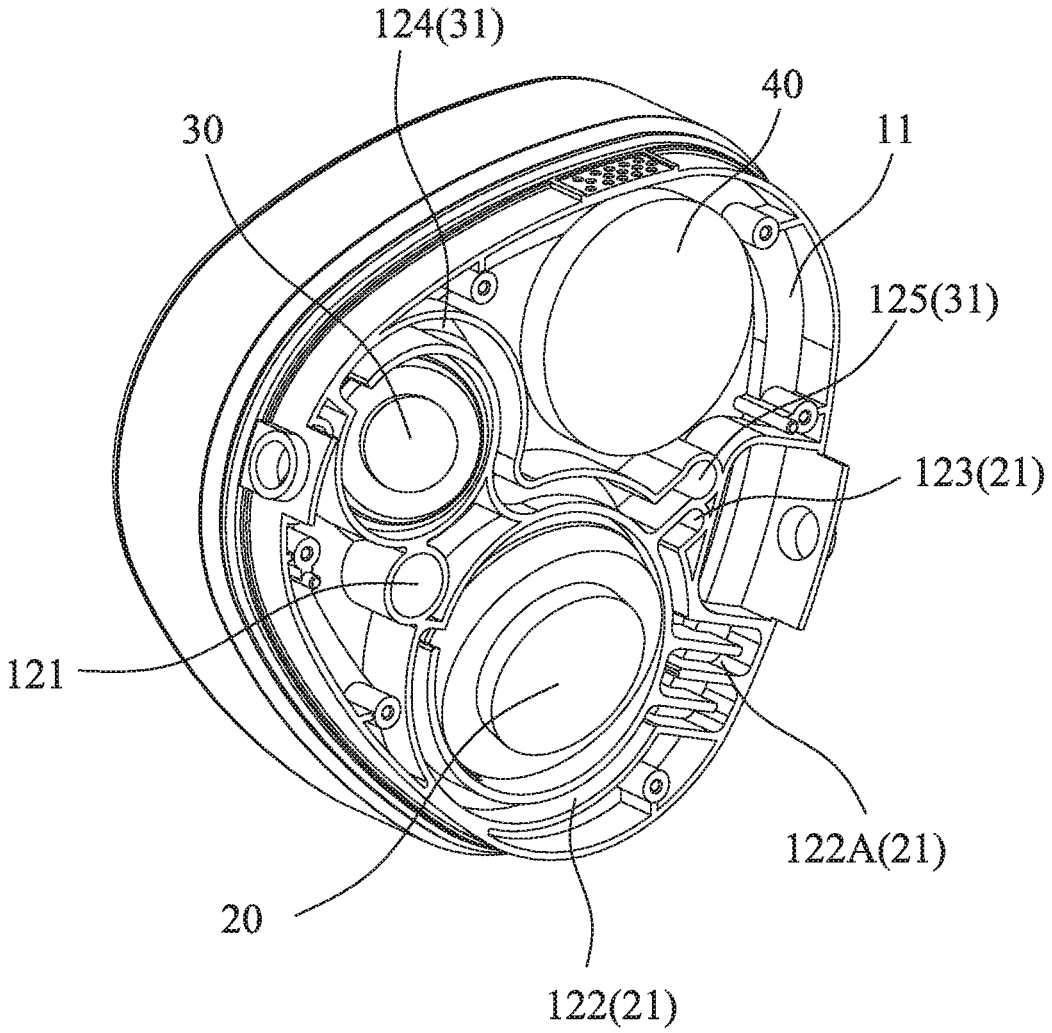
FIGS. 4A and 4B show a detailed structure of a first layer structure of the embodiment of the invention.
Figure 4B:
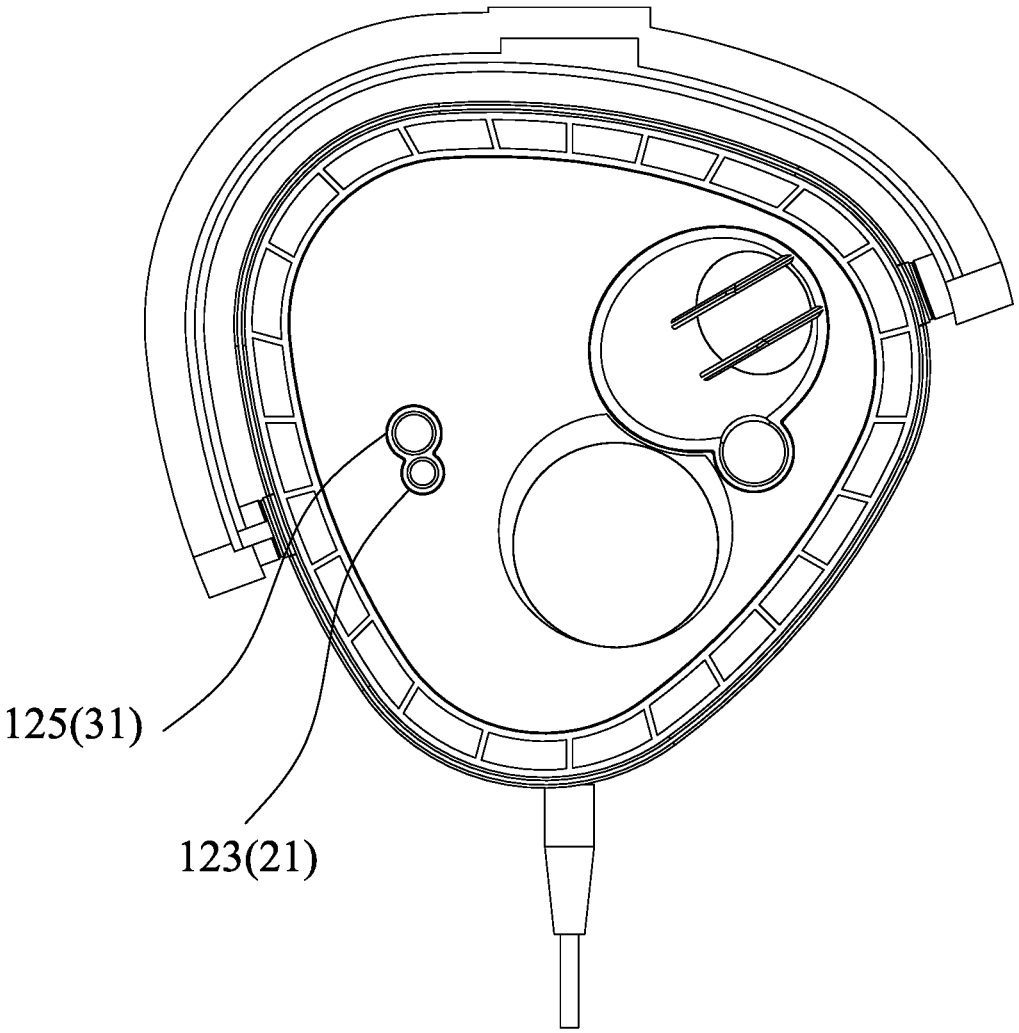

FIGS. 4A and 4B show a detailed structure of the first layer structure 11, wherein the low-pitch auxiliary path 21 extends into the first layer structure 11, and passes through the first layer structure 11 to the sound output side 19. The first layer structure 11 includes a first trench 122 and a third through hole 123. At least a portion of the first trench 122 extends around the low-pitch speaker 20 and is connected to the third through hole 123. The low-pitch auxiliary path 21 extends along the first trench 122 and the third through hole 123, and leaves the first layer structure 11.

In one embodiment, the first trench 122 includes a comb-shaped portion 122A, and the comb-shaped portion 122A delays the transmission of the sound.

With reference to FIGS. 4A and 4B, the first layer structure 11 includes a third trench 124 and a fourth through hole 125. At least a portion of the third trench 124 extends around the high-pitch speaker 30 and is connected to the fourth through hole 125. The high-pitch auxiliary path 31 extends along the third trench 124 and the fourth through hole 125, and leaves the first layer structure 11. In one embodiment, at least a portion of the third trench 124 surrounds the low-pitch speaker 20.

With reference to FIGS. 4A and 4B, in this embodiment, the third through hole 123 is adjacent to the fourth through hole 125. The second through hole 121 is located between the low-pitch speaker 20 and the high-pitch speaker 30. The low-pitch speaker 20 is located between the second through hole 121 and the third through hole 123. In other words, the comb-shaped portion 122A, the second through hole 121, the third through hole 123 and the fourth through hole 125 are arranged around the low-pitch speaker 20.

Utilizing the headphone of the embodiment of the invention with the crossfeed speaker, both the left ear and the right ear of the user can hear the sound of the right sound channel and the left sound channel. The design of the protrusion and the design of the path length and the shapes of the second trench and the third trench modify the time difference of the sound therein. Additionally, the frequency can be modified by the design of breathable holes and the first trench.

In one embodiment, when the volume of the low-pitch speaker 20 and the high-pitch speaker 30 is high, the volume of the crossfeed speaker 40 is low. When the volume of the low-pitch speaker 20 and the high-pitch speaker 30 is low, the volume of the crossfeed speaker 40 is high. Stereo sound is thereby provided.

With reference to FIG. 1A, in one embodiment, the headphone further includes a vent 15. The vent 15 is formed on a side of the housing 10, and communicates with outside air.

Figure 5A:
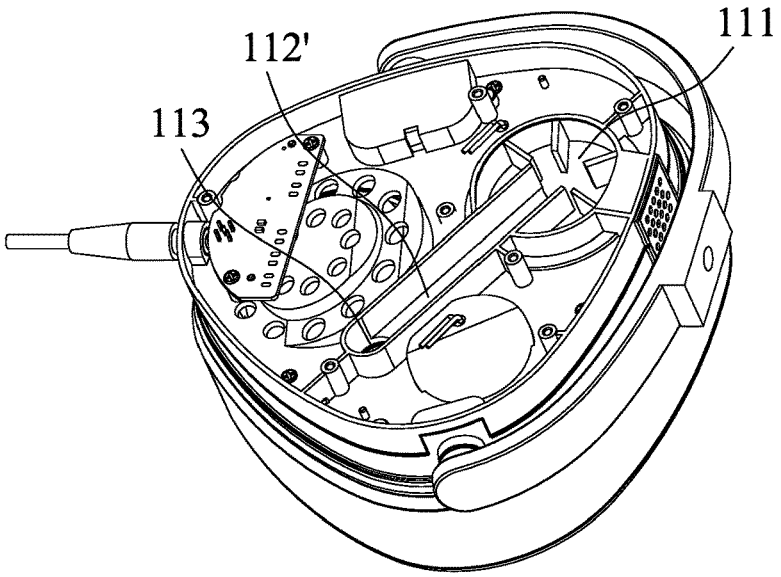
FIGS. 5A and 5B show a headphone of another embodiment of the invention.
Figure 5B:
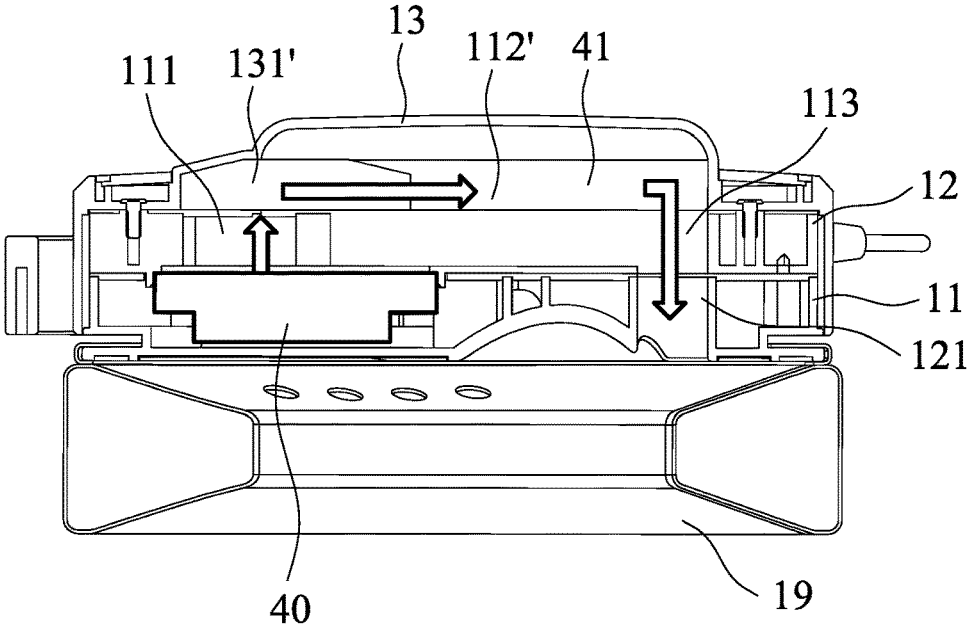

FIGS. 5A and 5B shows a headphone of another embodiment of the invention, wherein the crossfeed output path 41 extends between the second layer structure 12 and the cover structure 13, and passes through the second layer structure 12 and the first layer structure 11 to the sound output side 19. The second layer structure 12 includes an opening portion 111, a second trench 112' and a first through hole 113. The opening portion 111 corresponds to the crossfeed speaker 40. The second trench 122' is communicated to the opening portion 111 and the first through hole 113. The crossfeed output path 41 extends along the opening portion 111, the second trench 112' and the first through hole 113 to leave the second layer structure 12. The cover structure 13 includes a sound chamber 131'. The sound chamber 131' is connected to the opening portion 111 and the second trench 112'. The crossfeed output path 41 travels from the opening portion 111, the sound chamber 131', the second trench 112' and the first through hole 113 to leave the second layer structure 12. The sound chamber 131' is utilized to modify the frequency characteristics.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A headphone, comprising:

a housing, comprising a first layer structure, a first receiving space, a first output path, a first trench and a sound output side; and a speaker, located in the first receiving space, wherein the speaker comprises a first speaker orientation, and the first speaker orientation corresponds to the first output path, wherein the first output path comprises the first trench, wherein the first trench is located at the first layer structure, extends around the speaker, and is connected to the sound output side, wherein the housing further comprises a second output path, the speaker further comprises a second speaker orientation, and the second speaker orientation corresponds to the second output path, wherein a crossfeed output path travels between the second layer structure and the cover structure, passing through the second layer structure and the first layer structure to the sound output side, wherein the first speaker is in contact with a first inclined surface and the first speaker orientation corresponds to the first output path.

2. The headphone as claimed in claim 1, wherein the first speaker orientation is disposed next to the second speaker orientation, and the first speaker orientation and the second speaker orientation are arranged at inclined angles of about −10°~10°.

3. The headphone as claimed in claim 1, wherein the first speaker orientation and the second speaker orientation provide sounds with the same frequency or different frequencies, the first speaker orientation comprises a first speaker surface, and the second speaker orientation comprises a second speaker surface.

4. The headphone as claimed in claim 1, wherein a length of the first output path is longer than a length of the second output path.

5. The headphone as claimed in claim 1, wherein a second layer structure of the housing comprises an opening portion, a protrusion and a first through hole, and the opening portion corresponding to a crossfeed speaker, and a cover structure of the housing comprises a second trench, the second trench corresponding to the opening portion, the protrusion and the first through hole, and a crossfeed output path travels along the opening portion, the second trench and the first through hole to leave the second layer structure.

6. The headphone as claimed in claim 1, further comprising a crossfeed speaker, wherein the crossfeed speaker comprises a crossfeed speaker orientation, the crossfeed speaker orientation corresponds to a crossfeed output path, wherein the housing further comprises a second receiving space, and the crossfeed speaker is located in the second receiving space.

7. The headphone as claimed in claim 6, wherein the housing further comprises a cover structure and a second layer structure, the second layer structure is disposed between the first layer structure and the cover structure, the first layer structure is disposed between the second layer structure and the sound output side, the first receiving space and the second receiving space are disposed in the second layer structure, and the speaker and the crossfeed speaker are disposed in the first layer structure.

8. The headphone as claimed in claim 1, wherein the second layer structure comprises an opening portion, a protrusion and a first through hole, and the opening portion corresponds to the crossfeed speaker, the cover structure comprises a second trench, the second trench corresponds to the opening portion, the protrusion and the first through hole, and the crossfeed output path travels along the opening portion, the second trench and the first through hole to leave the second layer structure.

9. The headphone as claimed in claim 8, wherein the first layer structure comprises a second through hole, the second through hole corresponds to the first through hole, and the crossfeed output path travels from the second layer structure along the first through hole and the second through hole, passing through the first layer structure to the sound output side.

10. The headphone as claimed in claim 9, wherein the second output path extends into the first layer structure and passes through the first layer structure to the sound output side.

11. The headphone as claimed in claim 9, wherein the first layer structure comprises a third through hole, the third through hole is connected to the first trench, and the first output path travels along the first trench and the third through hole to leave the first layer structure.

12. The headphone as claimed in claim 11, wherein the first trench comprises a comb-shaped portion.

13. The headphone as claimed in claim 12, wherein the comb-shaped portion, the second through hole, and the third through hole are arranged around the speaker.

14. The headphone as claimed in claim 11, wherein the speaker is disposed between the second through hole and the third through hole.

15. The headphone as claimed in claim 7, wherein the second layer structure further comprises a plurality of vents, and the vents correspond to the speaker.

* * * * *